US009010924B2

(12) United States Patent
Leighton et al.

(10) Patent No.: US 9,010,924 B2
(45) Date of Patent: Apr. 21, 2015

(54) SYSTEM AND METHOD FOR ALIGNING DUPLEX IMAGES USING ALIGNMENT MARKS

(75) Inventors: Roger G. Leighton, Hilton, NY (US); Michael F. Leo, Penfield, NY (US); Vincent M. Williams, Palmyra, NY (US); Howard A. Mizes, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 196 days.

(21) Appl. No.: 13/546,259

(22) Filed: Jul. 11, 2012

(65) Prior Publication Data

US 2014/0015909 A1 Jan. 16, 2014

(51) Int. Cl.

| | |
|---|---|
| ***B41J 2/01*** | (2006.01) |
| ***B65H 23/32*** | (2006.01) |
| ***B41J 3/60*** | (2006.01) |
| ***B41J 11/46*** | (2006.01) |
| ***B41J 15/04*** | (2006.01) |

(52) U.S. Cl.

CPC . *B65H 23/32* (2013.01); *B41J 3/60* (2013.01); *B41J 11/46* (2013.01); *B41J 15/04* (2013.01); *B65H 2511/512* (2013.01)

(58) Field of Classification Search

CPC ..... B41J 11/007; B41J 11/06; B41J 11/0085; B41J 13/103; B41J 11/0065

See application file for complete search history.

(56) References Cited

U.S. PATENT DOCUMENTS

| | | | | |
|---|---|---|---|---|
| 6,595,465 | B2 * | 7/2003 | Lamothe | 242/615.21 |
| 6,607,320 | B2 | 8/2003 | Bobrow et al. | |
| 7,114,867 | B2 * | 10/2006 | Ohashi et al. | 400/642 |
| 7,561,843 | B2 | 7/2009 | deJong et al. | |
| 7,857,414 | B2 | 12/2010 | Eun et al. | |
| 7,878,617 | B2 | 2/2011 | Mizes et al. | |
| 2008/0143043 | A1 * | 6/2008 | Spence et al. | 271/225 |
| 2009/0265950 | A1 * | 10/2009 | Mizes et al. | 33/701 |
| 2010/0059567 | A1 | 3/2010 | Opfer et al. | |
| 2011/0064507 | A1 | 3/2011 | McLaughlin | |
| 2011/0199414 | A1 | 8/2011 | Lang | |

* cited by examiner

*Primary Examiner* — Manish S Shah
*Assistant Examiner* — Jeremy Delozier
(74) *Attorney, Agent, or Firm* — Maginot Moore & Beck LLP

(57) ABSTRACT

A system and method for adjusting a transport path length of a continuous web of recording media in a printing system printing duplex images. The method includes detecting alignment marks, for instance top of form (TOF) marks, on the continuous web of print media and adjusting the path length to provide substantially accurate registration of first and second images on opposite sides of the web for duplex imaging. The system to adjust path length includes idler rollers movable with respect to turnbar rollers.

8 Claims, 5 Drawing Sheets

SYSTEM AND METHOD FOR ALIGNING DUPLEX IMAGES USING ALIGNMENT MARKS

TECHNICAL FIELD

This disclosure relates generally to a method and apparatus for aligning duplex images being imaged by a printing system on a continuous web of print media having alignment marks, and more particularly to adjusting the length of a web media path while inverting the continuous web for imaging a second side of the web after imaging a first side.

BACKGROUND

In general, inkjet printing machines or printers include at least one printhead unit or marking engine that ejects drops of liquid ink onto recording media or an imaging member for later transfer to media. Different types of ink can be used in inkjet printers. In one type of inkjet printer, phase change inks are used. Phase change inks remain in the solid phase at ambient temperature, but transition to a liquid phase at an elevated temperature. The printhead unit ejects molten ink supplied to the unit onto media or an imaging member. Once the ejected ink is on media, the ink droplets solidify.

The media used in both direct and offset printers can be in web form. In a web printer, a continuous supply of media, typically provided in a media roll, is entrained onto rolls or rollers that are driven by motors. The motors and rolls pull the web from the supply roll through the printer to a take-up roll. The rollers are arranged along a linear media path, and the media web moves through the printer along the media path. As the media web passes through a print zone opposite the printhead or printheads of the printer, the printheads eject ink onto the web. Along the feed path, tension bars or other rolls remove slack from the web so the web remains taut without breaking.

Existing web printing systems use a registration control method to control the timing of the ink ejections onto the web as the web passes the printheads. One known registration control method that can be used to operate the printheads is the single reflex method. In the single reflex method, the rotation of a single roller at or near a printhead is monitored by an encoder. The encoder can be a mechanical or electronic device that measures the angular velocity of the roller and generates a signal corresponding to the angular velocity of the roll. The angular velocity signal is processed by a controller executing programmed instructions for implementing the single reflex method to calculate the linear velocity of the web. The controller can adjust the linear web velocity calculation by using tension measurement signals generated by one or more load cells that measure the tension on the web near the roll. The controller implementing the single reflex method is configured with input/output circuitry, memory, programmed instructions, and other electronic components to calculate the linear web velocity and to generate the firing signals for the printheads in the marking stations.

Another existing registration control method that can be used to operate the printheads in a web printing system is the double reflex method. In the double reflex method, each encoder in a pair of encoders monitors one of two different rollers. One roller is positioned on the media path prior to the web reaching the printheads and the other roller is positioned on the media path after the media web passes the printheads. The angular velocity signals generated by the two encoders for the two rolls are processed by a controller executing programmed instructions for implementing the double reflex method to calculate the linear velocity of the web at each roller and then to interpolate the linear velocity of the web at each of the printheads. These additional calculations enable better timing of the firing signals for the printheads in the marking stations and, consequently, improved registration of the images printed by the marking stations in the printing system. A double reflex printing system is disclosed in U.S. Pat. No. 7,665,817.

While control of the rotational speed of rollers can be critical for the proper registration of images, other factors besides web transport can affect image registration. For instance, the material properties of the recording media can affect registration of images. If the continuous web slips when engaged with one or more rollers in the media path, the position of the media web with respect to the printheads can be affected and errors in images formed on the media web can occur. If the web either stretches of shrinks during imaging, misregistration of images can also occur.

Some direct marking, continuous web printers are configured to print images onto both sides of the web, also referred to as duplex printing. To enable duplex printing on a continuous web, a web transport system can be configured to print onto one side of the web and direct the web back through an inversion system that inverts, or flips, the web over so that the opposite side is facing the printhead or printheads for completing the duplex image. In some printing systems, the inversion system can be located outside the printer and the continuous web can move from the printer to the inversion system and back to the printer. To invert the web for duplex printing, known systems can include turn bars that invert the web after printing one side (e.g., simplex side), and laterally offset the web to direct the web to the entrance of the duplex web path for printing on the other side (duplex side). In some printing systems, top of form (TOF) marks, also known as fiducial marks, are used to time the application of ink and properly register images. A fiducial mark can be printed at regular intervals, for example, at the beginning of a frame during the first pass and the second pass of the recording media when being moved through the marking engine. A frame is defined to include both the length of an imaging area on the recording media taken in the process direction and a non-imaging area located between a first image area and a second image area. The non-imaging area is called an inter-panel zone or inter-document zone.

In some printing systems, the printheads can deposit the alignment marks, for instance a pattern of dashes on the print media. The dashes can be imaged by a sensor, such as an ink on web array (IOWA) sensor. The dashes being imaged by the IOWA sensor can provide location information of the frames in the process direction. Because location of the nozzle or nozzles which produce each dash is known, the position of every print head can also be determined from the alignment marks.

A sensor detects the presence of the fiducial marks on the first pass and the second pass through the marking engine and provides signals to a controller configured to control the application of ink to the continuous web. In printers incorporating a duplex web path with an inversion system, the continuous web includes printed images on one side of the web as the web moves along a transport path from the printer to the inversion system and back to the printer. During this movement, the length of the web can change. Some sources of the change in length can be moisture loss in the paper due to the elevated temperature of the paper. To print properly aligned duplex images, the changes in the length of the paper path should be considered.

SUMMARY

A single print engine can print duplex images using a mobius return path. The mobius return path includes an inversion apparatus configured to invert a continuous web of recording media. The inversion apparatus is configured to invert the continuous web of recording media moving along a path in an imaging system. The inversion apparatus includes an input configured to receive the continuous web of recording media, an output, displaced from the input a first distance, wherein the output is configured to convey the continuous web of recording media after being inverted. A turnbar mechanism is disposed along the path between the input and the output and is configured to invert the continuous web of recording media. An idler roller device is disposed along the path between the input and the output wherein the idler roller device includes at least one idler roller and a driver operatively connected to the idler roller. The driver is configured to move the idler roller from a first position to a second position to change the first distance to a second distance.

A method of mechanically adjusting the length of a transport path during inversion of a continuous web of recording media uses top of form marks, also known as alignment marks to make the adjustment. Duplex images are formed on a continuous web of recording media having a first side, a second side, and a plurality of alignment marks. The continuous web moves along a transport path having a predetermined length through a printer and a web inverter. The method includes imaging the first side of the continuous web of recording media during a first pass through the printer, imaging the second side of the continuous web of recording media during a second pass through the printer, detecting the plurality of alignment marks to determine the spacing between the alignment marks, and modifying the predetermined length of the transport path based on the determined spacing of alignment marks.

A printing system is configured to deposit ink on a continuous web of recording media that has a plurality of fiducial marks to properly register duplex images for varying ink coverage, web thickness, speed of the web, thermal growth of the A frame, small changes in gap between the turn bar and media of varying widths, and moisture loss experienced by the web. The printing system is configured to deposit ink on the continuous web of recording media moving along a path and having the plurality of fiducial marks. The system includes an imaging device, an inversion apparatus, and a controller. The imaging device is configured to image the continuous web of recording media. The inversion apparatus is configured to invert the continuous web of recording media moving along the path to enable the imaging device to image a first side and a second side of the recording media. The inversion apparatus includes a first idler roller and a driver operatively connected to the idler roller wherein the driver is configured to move the first idler roller from a first position to a second position. A controller is operatively connected to the driver. The controller is configured to transmit a location signal to the driver to move the idler roller from the first position to the second position to change the length of the path from the imaging device to the inversion apparatus.

BRIEF DESCRIPTION OF THE DRAWINGS

The foregoing aspects and other features of a printing system including a mobius return path are explained in the following description, taken in connection with the accompanying drawings.

DETAILED DESCRIPTION

Figure 1:
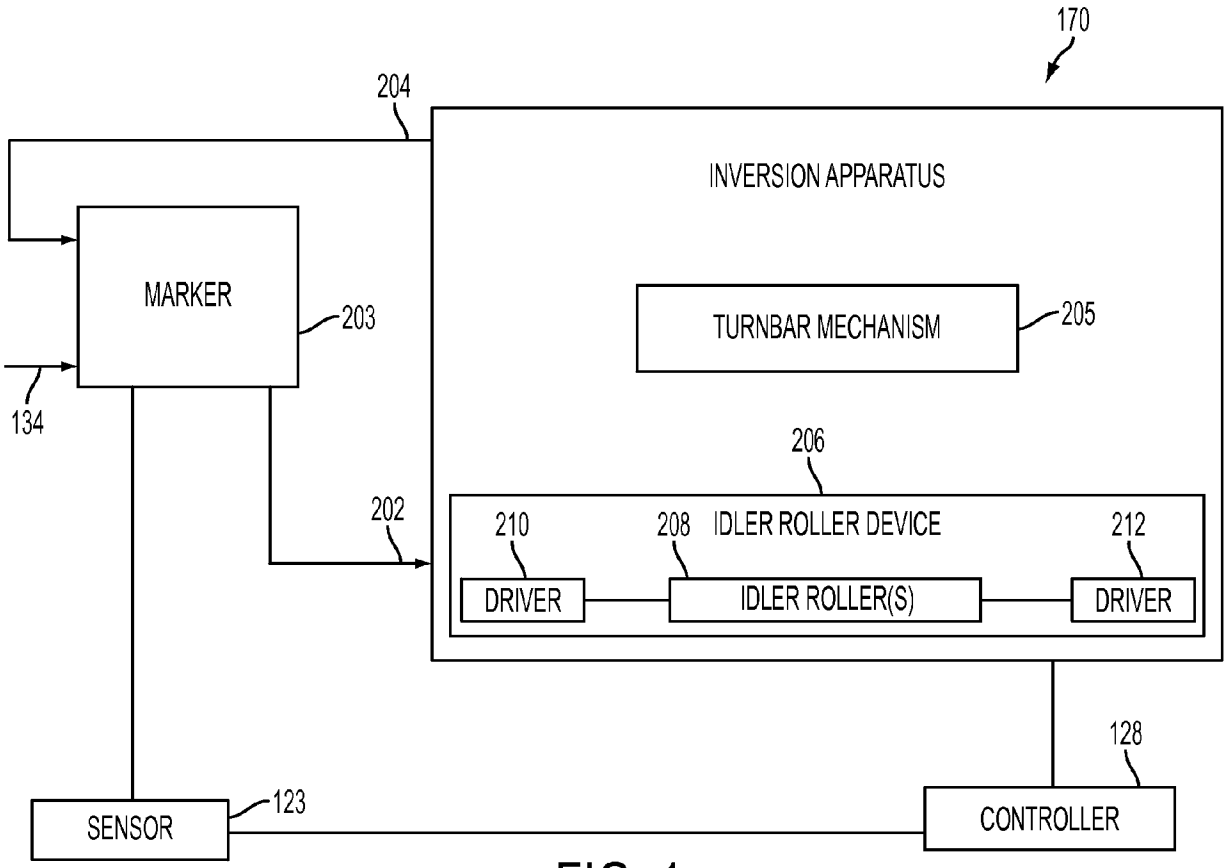
FIG. 1 is schematic block diagram of one embodiment of an inversion apparatus having a turnbar mechanism and an idler roller device.

For a general understanding of the environment for the system and method disclosed herein as well as the details for the system and method, the drawings are referenced throughout this document. In the drawings, like reference numerals designate like elements. As used herein the term "printer" or "printing system" refers to any imaging device or imaging system that is configured to eject a marking agent upon an image receiving member and includes photocopiers, facsimile machines, multifunction devices, as well as direct and indirect inkjet printers and any imaging device that is configured to form images on a print medium. As used herein, the term "process direction" refers to a direction of travel of an image receiving member, such as an imaging drum or a print medium, and the term "cross-process direction" is a direction that is perpendicular to the process direction. As used herein, the terms "web," "media web," and "continuous web of recording media" refer to an elongated print medium that is longer than the length of a media path that the web traverses through a printer during the printing process. Examples of media webs include rolls of paper or polymeric materials used in printing. The media web has two sides, a first side and a second side, each forming a surface that can receive images during printing. Each surface of the media web is made up of a grid-like pattern of potential drop locations, sometimes referred to as pixels.

Figure 6:
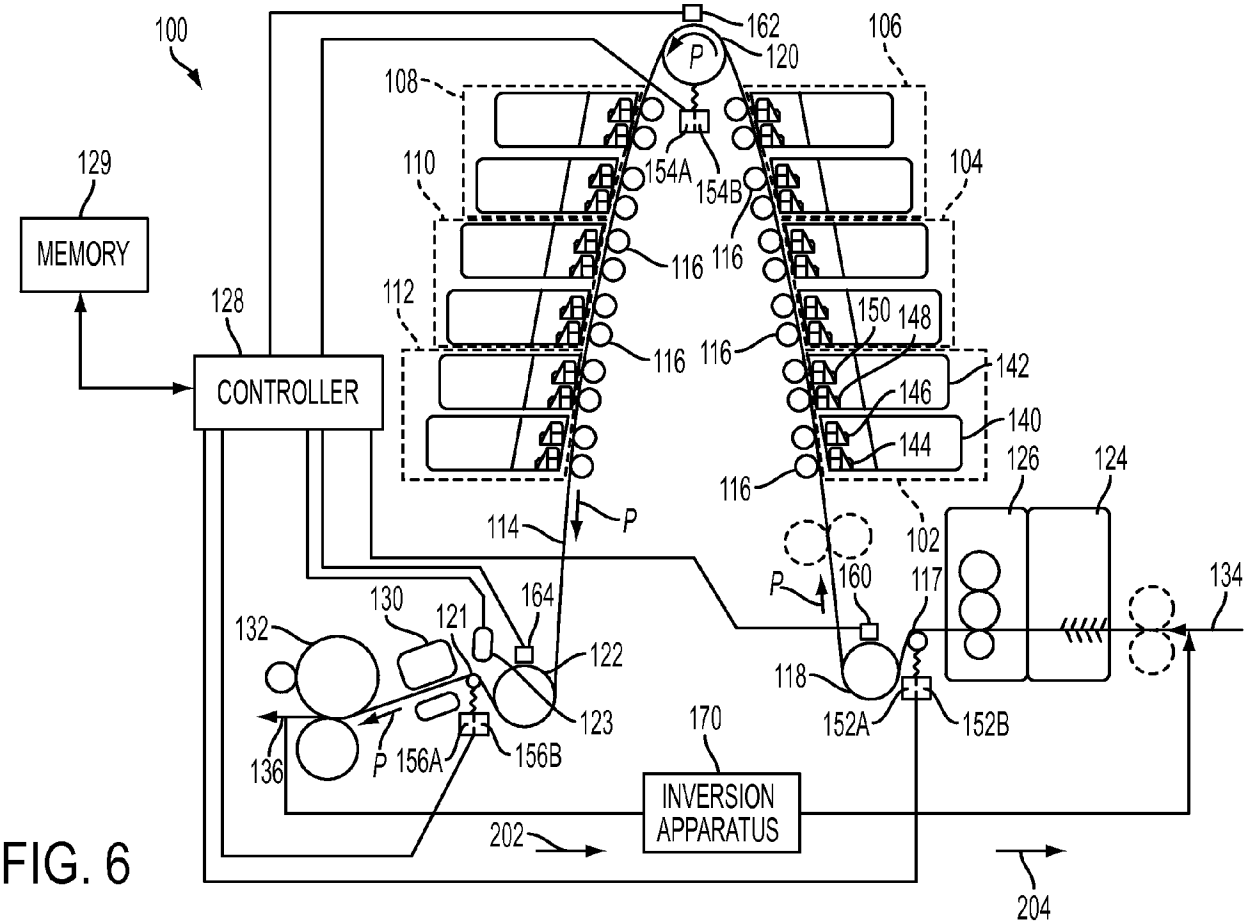
FIG. 6 is a schematic diagram of a duplex continuous web printing system.

As used herein, the term "capstan roll" refers to a cylindrical member configured to have continuous contact with the media web moving over a curved portion of the member, and to rotate in accordance with a linear motion of the continuous media web. As used herein, the term "angular velocity" refers to the angular movement of a rotating member for a given time period, sometimes measured in rotations per second or rotations per minute. The term "linear velocity" refers to the velocity of a member, such as a media web, moving in a straight line. When used with reference to a rotating member, the linear velocity represents the tangential velocity at the circumference of the rotating member. The linear velocity v for circular members can be represented as: $v=2\pi r\omega$ where r is the radius of the member and $\omega$ is the rotational or angular velocity of the member. FIG. 6 depicts an inkjet printer 100 having elements pertinent to the present disclosure. In the embodiment shown, the printer 100 implements a solid ink print process for printing onto a continuous media web. Although the inversion apparatus and method for printing on a moving web or recording media are described below with reference to the printer 100 depicted in FIG. 6, the subject method and apparatus disclosed herein can be used in any printer, such as a cartridge inkjet printer, which uses serially arranged printheads to eject ink onto a web image substrate.

FIG. 6 illustrates a continuous web printer system 100 that includes six print modules 102, 104, 106, 108, 110, and 112; a controller 128, a memory 129, guide rolls 116, pre-heater roller 118, apex roller 120, leveler roller 122, tension sensors 152A-152B, 154A-154B, and 156A-156B; and encoders 160, 162, and 164. The print modules 102, 104, 106, 108, 110, and 112 are positioned sequentially along a media path P and form a print zone for forming images on a print medium 114 as the print medium 114 travels past the print modules. The print modules 102, 104, 106, 108, 110, and 112 are also collectively known as a print engine. Each print module 102, 104, 106, 108, 110, and 112 in this embodiment provides an ink of a different color. In all other respects, the print modules 102, 104, 106, 108, 110, and 112 are substantially identical. The media web travels through the media path P guided by rolls 116, pre-heater roller 118, apex roller 120, and leveler roller 122. In FIG. 6, the apex roller 120 is an "idler" roll, meaning that the roller rotates in response to engaging the moving media web 114, but is otherwise uncoupled from any motors or other drive mechanisms in the printing system 100. The pre-heater roller 118, apex roller 120, and leveler roller 122 are each examples of a capstan roller that engages the media web 114 on a portion of its surface. A brush cleaner 124 and a contact roller 126 are located at one end of the media path P. A heater 130 and a spreader 132 are located at the opposite end 136 of the media path P.

The embodiment of FIG. 6 includes a web inverter or inversion apparatus 170 that is configured to route the media web 114 from the end 136 of media path to the beginning 134 of the media path through the inversion apparatus 170. The inversion apparatus 170 includes an input path 202, flips the media web, and includes an output path 204 to return the flipped web to the inlet 134 to enable duplex printing where the print modules 102-112 form ink images on a second side of the media web after forming images on the first side. The ink images are deposited within the imaging area on the continuous web and are separated by the inter-panel or inter-document zones or areas. The beginning of an image frame, the end of an image frame, or other marked locations can be used as an alignment mark. In this operating mode, a first section of the media web moves through the media path P in tandem with a second section of the media web, with the first section receiving ink images on the first side of the media web and the second section receiving ink images on the second side. This configuration can be referred to as a "mobius" configuration. Each of the print modules 102-112 is configured to eject ink drops onto both sections of the media web. Each of the rolls 116, 118, 120, and 122 also engage both the first and second sections of the media web. After the second side of the media web 114 is imaged, the media web 114 passes the end of the media path 136.

As illustrated in FIG. 6, print module 102 includes two print submodules 140 and 142. Print submodule 140 includes two print units 144 and 146. The print units 144 and 146 each include an array of printheads that are arranged in a staggered configuration across the width of both the first section of web media and second section of web media. In a typical embodiment, print unit 144 has four printheads and print unit 146 has three printheads. The printheads in print units 144 and 146 are positioned in a staggered arrangement to enable the printheads in both units to emit ink drops in a continuous line across the width of media path P at a predetermined resolution. In the example of FIG. 6, print submodule 140 is configured to emit ink drops in a twenty inch wide path that includes both the first and second sections of the media web at a resolution of 300 dots per inch. Ink ejectors in each printhead in print units 144 and 146 are configured to eject ink drops onto predetermined locations of both the first and second sections of media web 114. Print module 102 also includes submodule 142 that has the same configuration as submodule 140, but has a cross-process alignment that differs from submodule 140 by one-half of a pixel. This enables printing system 100 to print with twice the resolution as provided by a single print submodule. In the example of FIG. 6, submodules 140 and 142 enable the printing system 100 to emit ink drops with a resolution of 600 dots per inch. Each of the other print modules 104-112 can be similarly configured for duplex printing.

Operation and control of the various subsystems, components and functions of printing system 100 are performed with the aid of a controller 128 and memory 129. In particular, controller 128 monitors the velocity and tension of the media web 114 and determines timing of ink drop ejection from the print modules 102, 104, 106, 108, 110, and 112. The controller 128 can be implemented with general or specialized programmable processors that execute programmed instructions. Controller 128 is operatively connected to memory 129 to enable the controller 128 to read instructions and to read and write data required to perform the programmed functions in memory 129. Memory 129 can also store one or more values that identify the amount of tension for operating the printing system with at least one type of print medium used for the media web 114. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

Encoders 160, 162, and 164 are operatively connected to preheater roller 118, apex roller 120, and leveler roller 122, respectively. Each of the encoders 160, 162, and 164 are velocity sensors that generate an angular velocity signal corresponding to an angular velocity of a respective one of the rolls 120, 118, and 122. Typical embodiments of encoders 160, 162, and 164 include Hall effect sensors configured to generate signals in response to the movement of magnets operatively connected to the rolls and optical wheel encoders that generate signals in response to a periodic interruption to a light beam as a corresponding roller rotates. Controller 128 is operatively connected to the encoders 160, 162, and 164 to receive the angular velocity signals. Controller 128 includes hardware circuits or software routines configured to identify a linear velocity of each of the rolls 120, 118, and 122 using the generated signals and a known radius for each roll.

Tension sensors 152A-152B, 154A-154B, and 156A-156B are operatively connected to a guide roller 117, apex roller 120, and post-leveler roller 121, respectively. The guide roller 117 is positioned on the media path P prior to the preheater roller 118. The post-leveler roller 121 is positioned on the media path P after the leveler roller 122. Each tension sensor generates a signal corresponding to the tension force applied to the media web at the position of the corresponding roll. Each tension sensor can be a load cell configured to generate a signal that corresponds to the mechanical tension force between the media web 114 and the corresponding roll. A sensor 123 is positioned adjacent to the media web at a location along the web path after the last print module 112. In the embodiment of FIG. 6, the sensor is located along the media path P in the proximity of the leveler roller 122.

In the embodiment of FIG. 6 where two sections of the media web 114 engage each roller in tandem, each of the tension sensors are paired to identify the tension on each section of the media web 114. In embodiments where one surface of the media web engages each roll, a single tension sensor can be used instead. Tension sensors 152A-152B generate signals corresponding to the tension on the media web 114 as the media web 114 enters the print zone passing print modules 102-112. Tension sensors 154A-154B generate signals corresponding to the tension of the media web around apex roller 120 at an intermediate position in the print zone. Tension sensors 156A-156B generate signals corresponding to the tension of the media web around leveler roller as the media web 114 exits the print zone. The tension sensors 152A-152B, 154A-154B, and 156A-156B are operatively connected to the controller 128 to enable the controller 128 to receive the generated signals and to monitor the tension between apex roller 118 and the media web 114 during operation.

In operation, controller 128 measures the tension of the media web 114 at the guide roller 117, apex roller 120, and post-leveler roller 121. The velocity of the web 114 is measured on the preheat drum 118, apex roller 120, and leveler drum 122.

Referring now to FIG. 1, the printer system 100 includes the inversion apparatus 170 which is used by the printing system 100. The inversion apparatus 200 includes the input 202 which receives the media web 114 from end 136 after being imaged on a first side of the media by the print modules 102-112, here labeled as a marker 203. The media web 114 moves along a transport path from the end 136 toward the web inverter 170 of FIG. 6. After being inverted, the media web exits the inversion apparatus 200 at an output 204 which returns the media web along the transport path to the beginning 134 of the web path illustrated in FIG. 6.

While the inversion apparatus 200 can be included as an integrated component of a printing system, such as printing system 100, the inversion apparatus can also be a separate standalone apparatus. In the standalone configuration, the inversion system 200 can placed a distance from a printing system or print engine, where the web travels across the distance to reach the inversion apparatus and then returns to the printing system for completion of the duplex images. By making the inversion apparatus 200 a separate component, printing systems which can print both simplex and duplex images, but which are dedicated to the printing of only simplex images, can avoid the expense of an inversion system.

The inversion apparatus 200 includes a turnbar mechanism 205 which is operatively connected to an idler roller device 206. The turn bar mechanism 205 includes one or more turnbars each of which cooperate to invert the web as the web moves from the input 202 to the output 204. In addition to the turnbar mechanism being disposed along the transport path of the continuous web, the idler roller device 206 includes at least one idler roller 208 disposed along the transport path between the input 202 and the output 204. The idler roller 208 is cooperatively connected to and cooperatively positioned with respect to the one or more turnbars to enable inversion of the web by the turnbar mechanism 205. A first driver 210 and a second driver 212 are operatively connected to the idler roller 208 and provide positioning of the at least one idler roller 208 with respect to the at least one turnbar of the turnbar mechanism 205. The controller 128 is operatively connected to the inversion apparatus 200 and is configured to adjust the position of the at least one idler roller 208 with respect to the turnbar mechanism 205. A memory such as that previously described with respect to FIG. 6 can also be used Sensor 123 can be included at a location along the transport path after the web has been marked with a fiducial mark a second time by one of the printheads. The sensor 123 is disposed adjacent to the continuous web of recording media and is configured to detect a presence of a plurality of fiducial marks located on the continuous web of recording media. The sensor 123 can be configured to generate a signal upon a detection of one or more of the plurality of fiducial marks. The sensor can be an IOWA sensor, a TOF sensor, or other known sensor which can detect fiducial marks on the recording media, typically along an edge of the recording media.

In some embodiments, a sensor configured to sense fiducial marks located on the first side and the second side of the recording medium can be used. Because the web is inverted for the second pass through the print engine, the fiducial marks can be disposed on opposite sides of the media web. Consequently, the sensor 123 can include a first sensor and a second sensor each being located on opposite sides of the web. After a second pass of the web, the fiducial marks can be sensed by the first sensor located on the first side of the media web and by the second sensor located on the second side of the media web.

Alternatively, a single sensor can be used as the sensor 123 to detect the fiducial marks located on both sides of the media web. The second side image can be detected because the sensor is on the side of the media web facing the sensor. The first side image, however, is on the opposite side of the paper. If the sensor is a full width array sensor, then the fiducial marks can be designed so that a show through image can be observed by a sensor, such as an IOWA sensor as described in U.S. Patent Application Publication No. 2010/0329756.

The sensor 123 is also operatively connected to the controller 128 and is configured to transmit the generated signal to the controller to indicate the location of the fiducial marks with respect to the location of the sensor. The controller 128, which is configured to generate one or more signals to adjust the location or position of the idler roller(s), transmits a signal or signals to the drivers 210 and 212. Upon receipt of the signal from the controller 128, the drivers 210 and 212 adjust the position of the idler roller or rollers 208.

Figure 2:
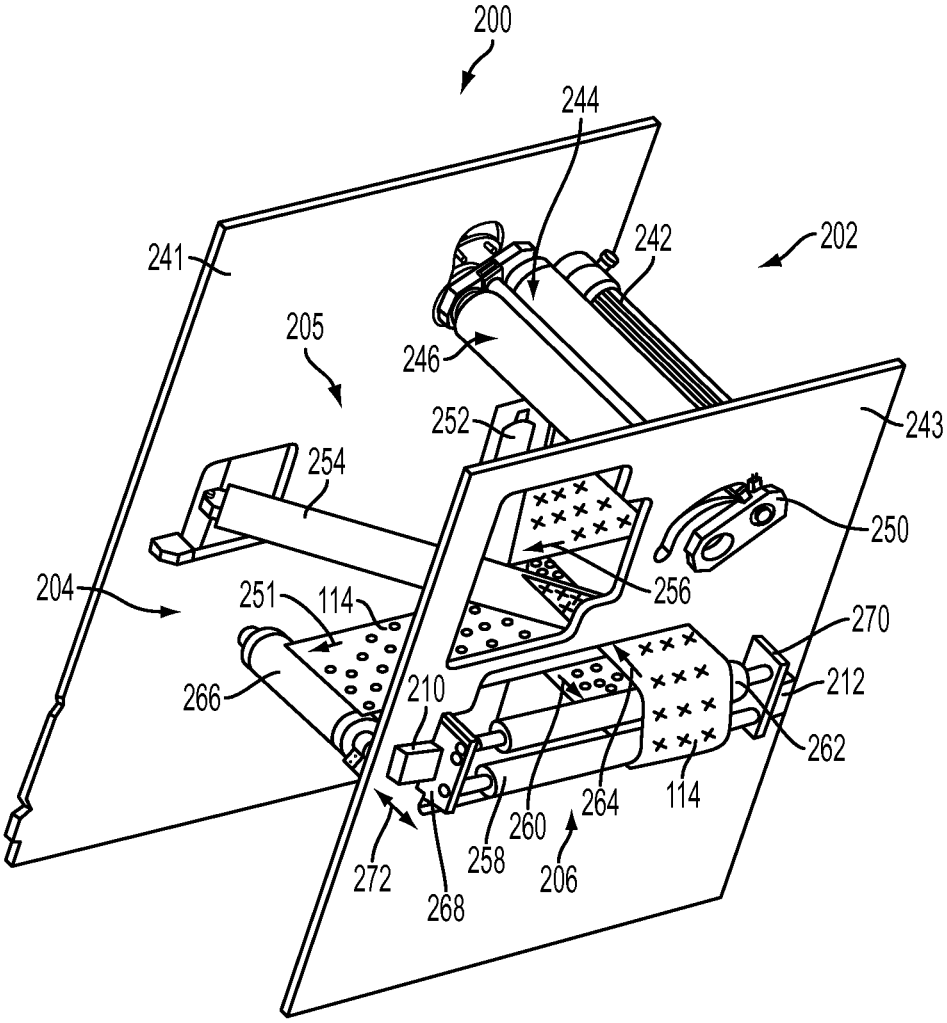
FIG. 2 is an elevational perspective view of one embodiment of an inversion apparatus.

FIG. 2 is an elevational perspective view of one embodiment of an inversion apparatus 200. The inversion apparatus 200 includes the input 202, the output 204, the turnbar mechanism 205, and the idler roller device 206. In the described embodiment, the inversion apparatus 200 includes the input 202 which is generally shown as being located on the right side, as illustrated, of the inversion apparatus 200. At the input 202, an input roller 242 initially receives and supports the web media after one side of the media has been imaged by the print modules 102, 104, 106, 108, 110, and 112. The roller 242 is supported by a frame including a first wall 241 and a second wall 243 which are disposed substantially parallel with respect to one another. Additional support structure (not shown) provides for a substantially rigid inversion apparatus 200 to provide substantially rigid support for the moving media web. The roller 242 substantially spans the distance between the first wall 241 and the second wall 243.

The input supply web 202 is shown as being located on the right side of the illustrated embodiment. The web is engaged by the swan neck (stationary spline and roller assembly) with edge guides 242, the media enters a rubber S wrap roller 244 and wraps around a second S-wrap roller 246 and proceeds through the machine for first pass printing. The web returns under the machine and arrives at the first turnbar roller 252.

Figure 3:
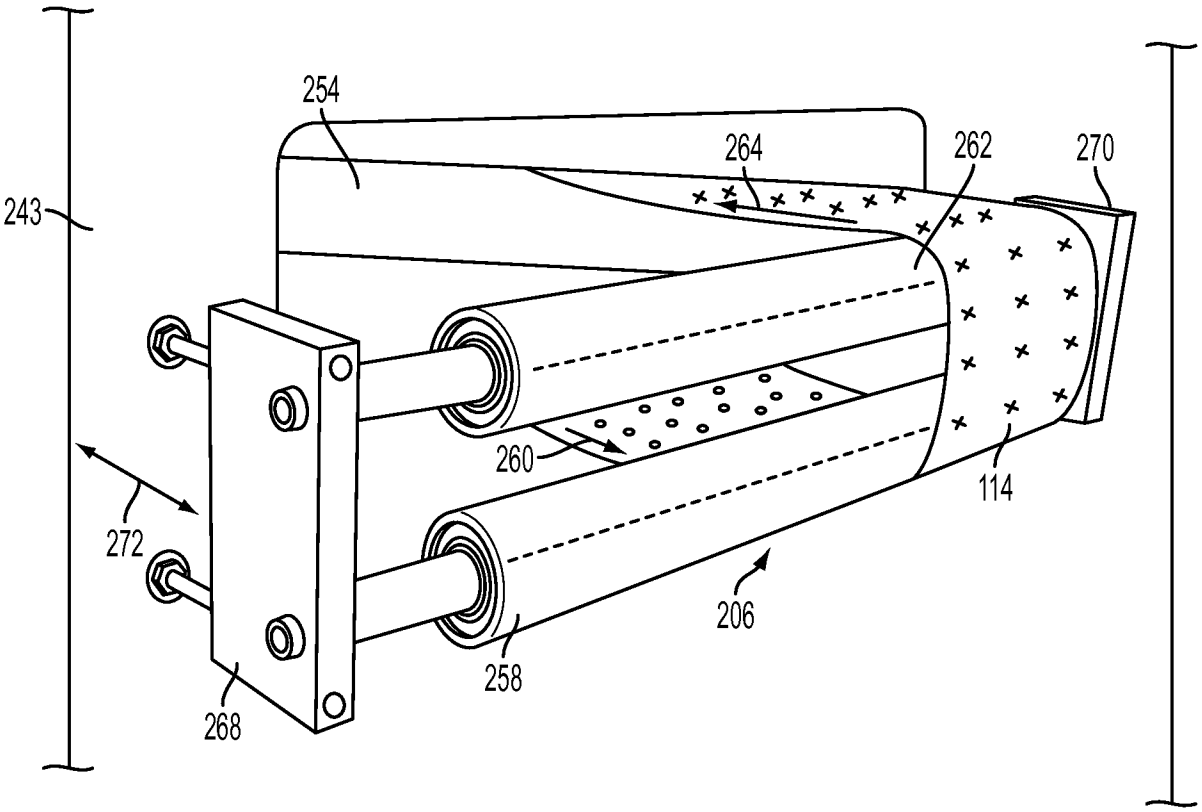
FIG. 3 is a partial elevational side view of an inversion apparatus.

The first turnbar roller 252 is generally diagonally supported by the first wall 241 and the second wall 243 with respect to a transport direction 251 of the media web 114 when being returned from the output 204 to the printing system. A second turnbar roller 254 is also generally diagonally supported by the first wall 241 and the second wall 243 with respect to the transport direction 251 of the media web 114 when returning to the printing system for completion of a duplex image. The first turnbar roller 252 is located beneath the second turnbar roller 254 as illustrated and receives the media web after passing up from the bottom of the machine from the supply side first pass. FIG. 3 illustrates a partial elevational side view of the inversion apparatus 200. As shown, the elevational relationship between the first turnbar roller 252 and the second turnbar roller 254 are illustrated as dotted lines in FIG. 3. The first turnbar roller 252 is also generally aligned at forty five degrees to the incoming web substantially perpendicular and planar to the second turnbar roller 254. In FIG. 2, the two opposing sides of the web 114 are distinguished with zeroes indicating one side of the web and X's indicating the other side of the web to illustrate the inversion of the web.

Once the web enters the turnbar assembly, the web is transported in a direction 256 across the top surface of the turnbar roller 252 and wraps around the turnbar roller 252 where the web is directed toward a first idler roller 258 in a direction 260. The web 114 is then directed towards a second idler roller 262 and moves in a direction 264 towards the second turnbar roller 254. The web 114 wraps around the second turnbar roller 254 and is directed toward the output 204 and an output roller 266. The first idler roller 258 and the second idler roller 262 can include a surface formed of a composite material placed on a metal roller. The composite material can either have a smooth surface or can be a treaded surface.

As illustrated in FIGS. 2 and 3, the first idler roller 258 and the second idler roller 262 are translationally supported by a first support 268 and a second support 270. The drivers 210 and 212 are respectively operatively connected to the first support 268 and the second support 270 and move the first and second idler rollers 258 and 262 bi-laterally in a direction 272. In FIG. 3, the drivers 210 and 212 are not shown.

If the frame size of the image is f, then the distance of a maximum misregistration between the side one image and the side two image is f/2. Since change in the paper length is equal to twice the distance the rollers can translate, the maximum distance the rollers must be able to translate is f/4. This maximum distance of translational motion provides sufficient dynamic range of the rollers to capture the maximum possible misregistration. Consequently, the drivers 210 and 212 are configured to move the rollers 258 and 262 in the direction 272 a distance of f/4.

In a calibration step, a frame size is selected based on the size of the frame to be imaged. If the path length PL of the web from the first pass through the predetermined sensor location to the second pass through the predetermined sensor location is approximately known from a previous measurement, then the approximate misalignment M between the first and second sides can be estimated. Specifically, the misalignment M is f multiplied by the fractional part of PL/f when the fractional part is less than 0.5. When the fractional part is greater than 0.5, the misalignment is the f multiplied by the fractional part subtracted from 1. For example, if PL=761 inches and f=11 inches, then PL/f=69.18. The fractional part is 0.18 times the frame size of 11 or 2 inches. Another way of stating this concept is that when the side 1 to side 2 image is misaligned, an adjustment will need to be made either towards the next side 1 image or the previous side one image. Once M is determined either through an estimate from a previous run, or a direct measurement in a calibration run, rolls 258 and 262 are translated a in the direction 272 distance M/2 from their present position. This translation can bring the alignment of the first side to the second side images to an alignment precision substantially equal to the measurement precision of sensor 123. In one embodiment, the alignment of images can be to within about +/−3 millimeters.

As illustrated in FIGS. 2 and 3, the first idler roller 258 and the second idler roller 262 are rotatably mounted to the first support 268 and a second support 270. The first and second idler rollers 258 and 262 respectively include rotational axis that are aligned substantially parallel with respect to one another. The first and second supports 268 and 270 are operatively connected to the first and second drivers 210 and 212. In one embodiment, the first and second drivers 210 and 212 are rigidly connected to the first side 243 and configured to move the rollers 258 and 262 and the supports 268 and 270 in the direction 272. To move in the direction 272, the first and second supports 268 and 270 can be mounted on tracks, rails, channels or other supports to provide linear movement of the first and second rollers 258 and 262 in the direction 272. In another embodiment, the supports 268 and 270 can be fixed to the side 243 and a sliding mechanism for linear movement in the direction 272 can be incorporated into the supports 268 and 270.

In one embodiment, the idler roller 258 and 262 are fixed with respect to one another and the drivers 210 and 212 move the rollers 258 and 262 simultaneously in the direction 272, which can be either in or out as illustrated to change the path length thus adjusting the side one to side two pitch. In another embodiment, one of the drivers 210 and 212 is independently positionable with respect to the other driver. In that case, the drivers 210 and 211 move only one of the rollers 258, 262. The change in position of at least one of the rollers adjusts the length of the path from the input 202 to the output 204. While two embodiments are described, other embodiments can include a mechanism which changes the length of the path from the input 202 to the output 204.

The idler rollers 258 and 262 support the web 114 as the web travels between the turnbars 252 and 254, which are also known as reverser bars. The idler rollers 258 and 262 are supported at a location exterior to the second wall 243. The rollers 258 and 262 each have a ninety degree wrap and can adjust the length of the transport path, also known as pitch length, between the input 202 and the output 204. Because the amount of tension on the web can affect printing on the web and can even break web if too much tension is present, the pitch length between the input 202 and the output 204 is changed slowly to adjust the path length. The change in path length will affect the instantaneous tension in the infeed to preheat drum tension zone. Since both the supply and return webs are webbed over the load cell, the rate of change must be slow enough that the tension remains constant throughout.

Slowly changing the path length reduces the likelihood that the web tension is not changed to such an extent that a break in the web can occur. The path length is adjusted, however, at a sufficient rate of speed to maintain active TOF mark alignments between the simplex and duplex images under varying ink coverage conditions which can include, web thickness, web speed, and web moisture loss. The drivers 210 and 212 move slowly to change the overall path length to manage the printing on the second side of the web 114 to complete a duplex image. The precessing and advancing of the image misalignment can occur over many images to avoid breakage of the web. Therefore, the mechanical bandwidth and speed of response is a very low frequency on the order of approximately less than one-tenth (0.1) hertz. A slight rise or fall in tension can accompany any movement until the new path length reaches an equilibrium level as long as tearing or breaking of the web is avoided.

The drivers 210 and 212 can include a dual lead screw low backlash cam shaft pivot arm mechanism (not shown) driven by either a servo motor or stepper motor driven assembly. As the sensor 123 provides location information of the TOF marks to the controller 128, the controller provides adjusting signals to the drivers 210 and 212 to adjust the pitch length. While the drivers 210 and 212 can be used to adjust the pitch length, movement of the rollers 258 and 262 in the direction 272 can also be made manually without the use of drivers 210 and 212.

Figure 4:
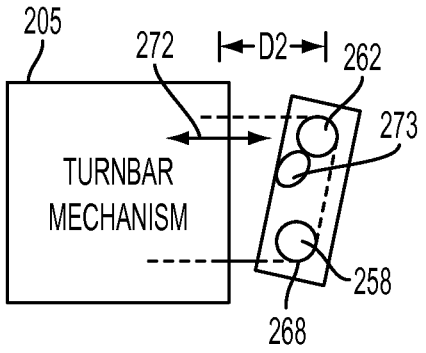
FIG. 4 illustrates a schematic diagram of one embodiment of an idler roller device positioned with respect to a turnbar mechanism having a first idler roller positionable with respect to the idler roller device to adjust the web media path length.

In another embodiment as illustrated in FIG. 4, the drivers 268 and 270 can be used to make a course or gross adjustment of the path length to provide an initial adjustment of registration between a first side image and a second side image of the web. The initial course adjustment can be sufficient in some instances to satisfactorily register the second side image with the first side image. In other instances of registration, a fine adjustment of first side to second side image registration can be made by moving one of the rollers 258 and 262 generally in the direction 272 while the other of the rollers 258 and 262 remains fixed. Once the course adjustment is made, a fine adjustment can be made to move the second roller 262 an additional amount in the direction 272 such that the distance between the roller 262 and the turnbar mechanism 205 increases along the direction D2.

The location of the first idler roller 258 remains fixed with respect to the turnbar roller 252 and the location of the second idler roller 262 is adjusted to change the length of the media path to thereby compensate for the misregistration of images used to form a duplex image. The idler roller 262 can be moved by a cam or cams 273 and a stepper motor (not shown) located at the idler roller 262 or at the supports 268 and 270. In this embodiment, the distance D2 is adjustable and the idler roller 262 is positioned accordingly to adjust registration.

The cam or cams 273 can be operatively connected to the supports 268 and 270 to move one end of the support away from the turnbar mechanism 205 while the other end remains fixed with respect to the turnbar mechanism 205. The end of the support supporting the roller 262 cantilevers about the roller 258. The amount of movement of the roller 262 with respect to the turnbar mechanism 205 depends on the accuracy of the course positioning. The roller 268 can be moved further away from or closer to the turnbar mechanism 205. While the embodiment of FIG. 4 can be used to adjust the length of the transport path, moving both of the rollers 258 and 262 simultaneously in the direction 272 of FIG. 3 can provide the exemplary state for moving the web. Moving both of the rollers 258 and 262 together maintains the ninety degree wrap on both the rollers and the correct tangent entrance angle for one hundred eighty degree total wrap.

Figure 5:
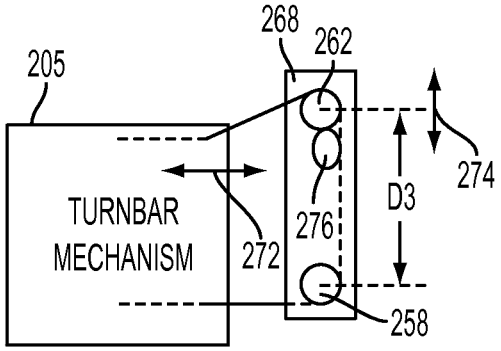
FIG. 5 illustrates a schematic diagram of another embodiment of an idler roller device positioned with respect to a turnbar mechanism with a first idler roller positionable with respect to a second idle roller to adjust the web media path length.

In another embodiment as illustrated in FIG. 5, the idler roller 258 remains fixed and the location of the idler roller 262 can be adjusted to address issues of misregistration. After a course adjustment along the direction 272, the roller 262 is moved along a direction 274 by a cam or cams 276 to adjust the distance D3. In the embodiment of FIG. 5, the movement of roller 262 in the direction 274 should remain relatively small as too much movement in the direction 274 can skew the movement of the continuous web when being inverted by the turnbar mechanism.

To adapt the inversion apparatus 200 to different printing environments and operating conditions, including enabling printing on different types of web media, the inversion apparatus 200 can be located a predetermined distance with respect to the first print module 102. The inversion apparatus 200 can include wheels or tracks (not shown) upon which the inversion apparatus can be moved with respect to the first print module. Before printing begins, an operator can adjust the inversion apparatus 200 into a predetermined position that represents a set of standard image pitches in the return transport path from the output 204 to the first print module 102. This initial position is used to approximately locate the first side image and second side image to complete a registered duplex image. The approximate location of the inversion apparatus 200 is selected such that the adjustment travel of the inversion apparatus 200 with respect to ground is one-half a total alignment error.

When both of the rollers 258 and 262 are moved together as illustrated in FIG. 3, the net length increase of the web path is exactly 2X of the error. Therefore, if the error measures 1X between the images then the two idler rollers are moved out of plane by 0.5X. If one idler roller is moved, such as that shown in FIG. 4, then for small relative movements the change in the web length is approximately equal to the movement of the roller away from the turnbar.

Further adjustment can be made by a course adjustment of the rollers 258 and 262 in the direction 272 and then a fine adjustment through positioning of the one of the rollers, such as roller 262 as described above. While fine adjustment has been described by movement of a single roller, simultaneous movement of both rollers 258 and 262 in the direction 272 can be used for fine adjustment as long as the positioning can be effectively controlled to provide a desired registration.

Alignment to properly register duplex images can be made by adjusting the return path length to match the frame size of images. Such alignment can be made manually without real-time control during before printing using the previously described measurement of the path length, can be made automatically by tracking the TOF marks, or can be made by monitoring image registration marks made by the printhead. For a manual registration, the path length can be adjusted to have a path length equal to an integer number of printing frames. By this adjustment, the printing frame which is to receive the second side image can return to the print zone appropriately timed for proper registration with respect to the print zone. The controller provides information of the first side image location, assuming all first sides were printed within a fixed length frame (and neglecting media characteristics such as shrinkage). The desired length of the return path can be determined based upon the length of the known printed frame. The position of the idler rollers 258 and 262 is set accordingly. For instance in one embodiment having an eleven inch print frame, the length of the return print path is approximately seventy two frames. This length resulted in providing an additional five inches to the nominal return path length to achieve exactly seventy two full frames.

Once the length of the return path has been manually determined, fine adjustments can be made based on printing a test image and manually measuring the first side and the second side displacement errors. After manually measuring the displacement errors, the length of the return path can be further adjusted. The TOF marks, the inter-document zone registration marks, or a specifically designed test target can be used without being sensed electronically. After the initial determination of path length has been determined and the inversion apparatus 200 has been located accordingly, the following fine adjustments to path length can be made, for instance: (1) automatic adjustment of the idler roller positions can be made by using the drivers, but still manually measuring the registration error; (2) manual adjustment of the length at the start of a print job can be made and finer adjustment of the length can be made based on known or expected media behavior, such as shrinkage, without sensing the error; (3) determination of the location of the TOF marks can be made with the sensor and real time adjustments can be made under direction of the controller 128 for printing applications that require more precise alignment; and (4) use of a sensing mechanism other than the use of TOF marks can be made, such as inter-document zone (IDZ) registration patterns or an inspection station located after the print zone which communicates a registration error to the adjustment mechanism controller 128.]

To provide the fine adjustment of the length of the transport path, one or more cams can be moved by the servo motor in response to a signal generated by the controller 128 using the TOF mark signals provided by the sensor 123. In one embodiment, only a relatively small amount of movement to correct a registration error of approximately ±3 millimeters (fine error) can be achieved using one or more of the cams. Other amounts of adjustment can be made depending on the type of driver used to move the one or both of the rollers 258 and 262. By making a relatively accurate rough adjustment by moving the location of the inversion apparatus 200 with respect to the printer or by moving one or both of the rollers 258 and 262 with respect to the turnbar mechanism, the cam or cams can operate through a small range of movement from the top dead center position to achieve the fine adjustment. This adjustment can maintain a consistent 180 degree wrap on the second turnbar 254 without introducing compound angles to the tangent of the turnbar 254. The single shaft and twin cam arrangement with one cam at each end of the roller 262 can provide parallel motion of the center of the roller 262 so that steering moments are not introduced into the web 114.

It will be appreciated that variants of the above-disclosed and other features and functions, or alternatives thereof, can be desirably combined into many other different systems, applications or methods. For instance, the described embodiments and teachings can be applied to printing systems where the characteristics of a continuous web of recording media can change over time. Various presently unforeseen or unanticipated alternatives, modifications, variations or improvements can be subsequently made by those skilled in the art that are also intended to be encompassed by the following claims.

What is claimed is:

1. A system configured to form images on a continuous web of recording media having a plurality of fiducial marks and moving along a path comprising:

an imaging device configured to image the continuous web of recording media;

an inversion apparatus configured to invert the continuous web of recording media moving along the path to enable the imaging device to image a first side and a second side of the recording media, the inversion apparatus including a first turnbar, a second turnbar, a first idler roller and a driver operatively connected to the idler roller, the first idler roller of the inversion apparatus being disposed along the path along which the web moves between the first turnbar and the second turnbar and the driver being configured to move the first idler roller from a first position to a second position to alter a length of the path along which the web moves between the first idler arm and the first turnbar and to alter a length along which the web moves between the first idler arm and the second turnbar; and a controller, operatively connected to the driver, the controller being configured to transmit a location signal to the driver to move the idler roller from the first position to the second position to alter the length of the path along which the web moves between the first idler arm and the first turnbar and to alter the length of the path along which the web moves between the first idler arm and the second turnbar.

2. The system of claim 1, the inversion apparatus further comprising:

a second idler roller spaced from the first idler roller; and the driver is configured to move the second idler roller from the first position to the second position to change the length of the path along which the web moves between the first and the second idler arms and the first turnbar and to alter the length of the path along which the web moves between the first and the second idler arms and the second turnbar.

3. The system of claim 2 further comprising:

a sensor configured to detect a presence of the plurality of fiducial marks located on the continuous web and to generate a signal upon a detection of the plurality of fiducial marks.

4. The system of claim 3, the controller being operatively connected to the sensor and to the driver, and the controller being further configured to generate a driver signal in response to the signal generated by the sensor and to transmit the driver signal to the driver.

5. The system of claim 2 wherein the driver is configured to move the first idler roller and the second idler roller simultaneously.

6. The system of claim 2 wherein the first turnbar and the second turnbar are perpendicular to one another.

7. The system of claim 2 wherein the first turnbar and the second turnbar are parallel to one another.

8. The system of claim 2 wherein the first turnbar and the second turnbar are oriented at a forty-five degree angle to one another.

* * * * *